US010220289B2

(12) United States Patent
Habiche

(10) Patent No.: US 10,220,289 B2
(45) Date of Patent: Mar. 5, 2019

(54) DEVICE FOR PRACTICING SPORT ACTIVITIES

(71) Applicant: Leila Benedicte Habiche, Monaco (MC)

(72) Inventor: Leila Benedicte Habiche, Monaco (MC)

( * ) Notice: Subject to any disclaimer, the term of this patent is extended or adjusted under 35 U.S.C. 154(b) by 3 days.

(21) Appl. No.: 15/321,850

(22) PCT Filed: Jun. 26, 2015

(86) PCT No.: PCT/IB2015/054818
§ 371 (c)(1),
(2) Date: Dec. 23, 2016

(87) PCT Pub. No.: WO2016/005853
PCT Pub. Date: Jan. 14, 2016

(65) Prior Publication Data

US 2017/0136339 A1 May 18, 2017

(30) Foreign Application Priority Data

Jul. 7, 2014 (IT) ..... MI2014A1233

(51) Int. Cl.
*A63B 24/00* (2006.01)
*A63B 71/06* (2006.01)
(Continued)

(52) U.S. Cl.
CPC ..... *A63B 71/0622* (2013.01); *A63B 22/0076* (2013.01); *A63B 22/02* (2013.01);
(Continued)

(58) Field of Classification Search
CPC ..... A63B 22/0076; A63B 22/02; A63B 22/04; A63B 22/06; A63B 22/0605;
(Continued)

(56) References Cited

U.S. PATENT DOCUMENTS 4,674,743 A * 6/1987 Hirano ..... A61B 5/0017 340/323 R
4,779,615 A * 10/1988 Frazier ..... H04R 1/028 601/111
(Continued)

FOREIGN PATENT DOCUMENTS

DE 20 2009 009 078 U1 2/2010
EP 2 716 331 A2 4/2014
(Continued)

*Primary Examiner* — Gary D Urbiel Goldner
(74) *Attorney, Agent, or Firm* — Vorys, Sater, Seymour and Pease LLP

(57) ABSTRACT

A device for practicing sport activities is associated with an exercise machine. The device for practicing sport activities comprises a plurality of diffusers designed to emit stimuli and including at least one speaker configured to emit music, a controller of the device for practicing sport activities, including a program of the sport activities to be performed and a relative intensity of the sport activities. The controller is configured to adjust the emitted stimuli propagated by the plurality of diffusers according to the sport activities to be performed and the relative intensity of the sport activities.

7 Claims, 1 Drawing Sheet

(51) Int. Cl.
*A63B 22/00* (2006.01)
*A63B 22/02* (2006.01)
*A63B 22/04* (2006.01)
*A63B 22/06* (2006.01)

(52) U.S. Cl.
CPC ..... *A63B 22/04* (2013.01); *A63B 22/0605* (2013.01); *A63B 24/0062* (2013.01); *A63B 24/0087* (2013.01); *A63B 71/0686* (2013.01); *A63B 22/0056* (2013.01); *A63B 2024/0096* (2013.01); *A63B 2071/063* (2013.01); *A63B 2071/0625* (2013.01); *A63B 2071/0638* (2013.01); *A63B 2071/0658* (2013.01); *A63B 2207/02* (2013.01); *A63B 2220/17* (2013.01); *A63B 2220/70* (2013.01); *A63B 2225/50* (2013.01); *A63B 2230/06* (2013.01); *A63B 2230/40* (2013.01)

(58) Field of Classification Search
CPC ..... A63B 24/0062; A63B 24/0075; A63B 24/0084; A63B 24/0087; A63B 2024/0065; A63B 2024/0068; A63B 2024/0071; A63B 2024/0078; A63B 2024/0081; A63B 2024/009; A63B 2024/0093; A63B 2024/0096; A63B 71/06; A63B 71/0619; A63B 71/0622; A63B 71/065; A63B 71/0686; A63B 2071/0625; A63B 2071/0627; A63B 2071/063; A63B 2071/0638; A63B 2071/0641; A63B 2071/0644; A63B 2071/0647; A63B 2071/0655; A63B 2071/0658; A63B 2071/0675; A63B 2071/0677; A63B 2071/068; A63B 2071/0683; A63B 2207/00; A63B 2207/02; A63B 2220/17; A63B 2220/30; A63B 2220/31; A63B 2220/62; A63B 2220/64; A63B 2225/20; A63B 2225/50; A63B 2225/52; A63B 2225/54; A63B 2230/06; A63B 2230/062; A63B 2230/065; A63B 2230/04; A63B 2230/405; A63B 2230/42; A63B 2230/425
See application file for complete search history.

(56) References Cited

U.S. PATENT DOCUMENTS 5,667,459 A * 9/1997 Su ..... A63B 71/0622 482/1
6,027,463 A * 2/2000 Moriyasu ..... A61H 23/0236 601/46
6,152,856 A * 11/2000 Studor ..... A63B 24/00 434/247
6,336,891 B1 * 1/2002 Fedrigon ..... A63B 24/0006 434/247
7,465,257 B1 12/2008 Morgan, Jr.
7,841,967 B1 * 11/2010 Kahn ..... G06F 19/3456 482/8
2002/0002103 A1 * 1/2002 Watterson ..... A63B 22/0235 482/54
2002/0165067 A1 * 11/2002 Watterson ..... A63B 21/005 482/54
2004/0259689 A1 * 12/2004 Wilkins ..... A63B 5/00 482/8
2005/0124463 A1 * 6/2005 Yeo ..... A61B 5/02427 482/8
2005/0195094 A1 * 9/2005 White ..... A63B 24/0021 340/870.01
2006/0122035 A1 * 6/2006 Felix ..... A63B 22/0023 482/8
2006/0201580 A1 * 9/2006 Kang ..... A63B 69/00 144/195.5
2007/0042868 A1 * 2/2007 Fisher ..... A63B 24/0084 482/8
2007/0123390 A1 5/2007 Mathis
2007/0249467 A1 * 10/2007 Hong ..... A63B 22/00 482/1
2007/0265138 A1 * 11/2007 Ashby ..... A63B 22/02 482/8
2008/0051919 A1 * 2/2008 Sakai ..... A63B 71/00 700/94
2008/0097633 A1 * 4/2008 Jochelson ..... A63B 71/0686 700/94
2008/0161161 A1 * 7/2008 Pipinich ..... A63B 24/0062 482/8
2008/0220940 A1 * 9/2008 Kasama ..... A63B 24/0062 482/8
2008/0242511 A1 * 10/2008 Munoz ..... A63B 22/02 482/5
2009/0044687 A1 * 2/2009 Sorber ..... A63B 71/0622 84/609
2011/0034300 A1 * 2/2011 Hall ..... A63B 5/11 482/1
2011/0152696 A1 * 6/2011 Ryan ..... A61B 5/222 600/481
2012/0029666 A1 * 2/2012 Crowley ..... A63B 24/0062 700/91
2012/0053016 A1 * 3/2012 Williamson ..... A63B 24/0062 482/8
2012/0295763 A1 * 11/2012 Lin ..... A63B 5/11 482/4
2013/0035215 A1 * 2/2013 Ashby ..... A63B 22/0242 482/54
2014/0163439 A1 * 6/2014 Uryash ..... A61B 8/08 601/47
2014/0240122 A1 * 8/2014 Roberts ..... G16H 40/63 340/539.11
2014/0248996 A1 * 9/2014 Adel ..... A63B 24/0062 482/8
2014/0273849 A1 * 9/2014 Lee ..... G06F 1/1694 455/41.2
2014/0276193 A1 * 9/2014 Doochin ..... A61H 23/0245 600/552
2014/0278219 A1 * 9/2014 Canavan ..... A63B 24/0062 702/150
2015/0082408 A1 * 3/2015 Yeh ..... A61B 5/7415 726/9
2015/0196801 A1 * 7/2015 Erkkila ..... A63B 71/0619 700/91
2015/0306458 A1 * 10/2015 Watarai ..... A63B 24/0062 340/432
2015/0367176 A1 * 12/2015 Bejestan ..... G06F 19/3481 482/9
2016/0107063 A1 * 4/2016 Watanabe ..... G06Q 10/0639 348/157

FOREIGN PATENT DOCUMENTS

WO 2004/072767 A2 8/2004
WO 2008/129443 A2 10/2008

* cited by examiner

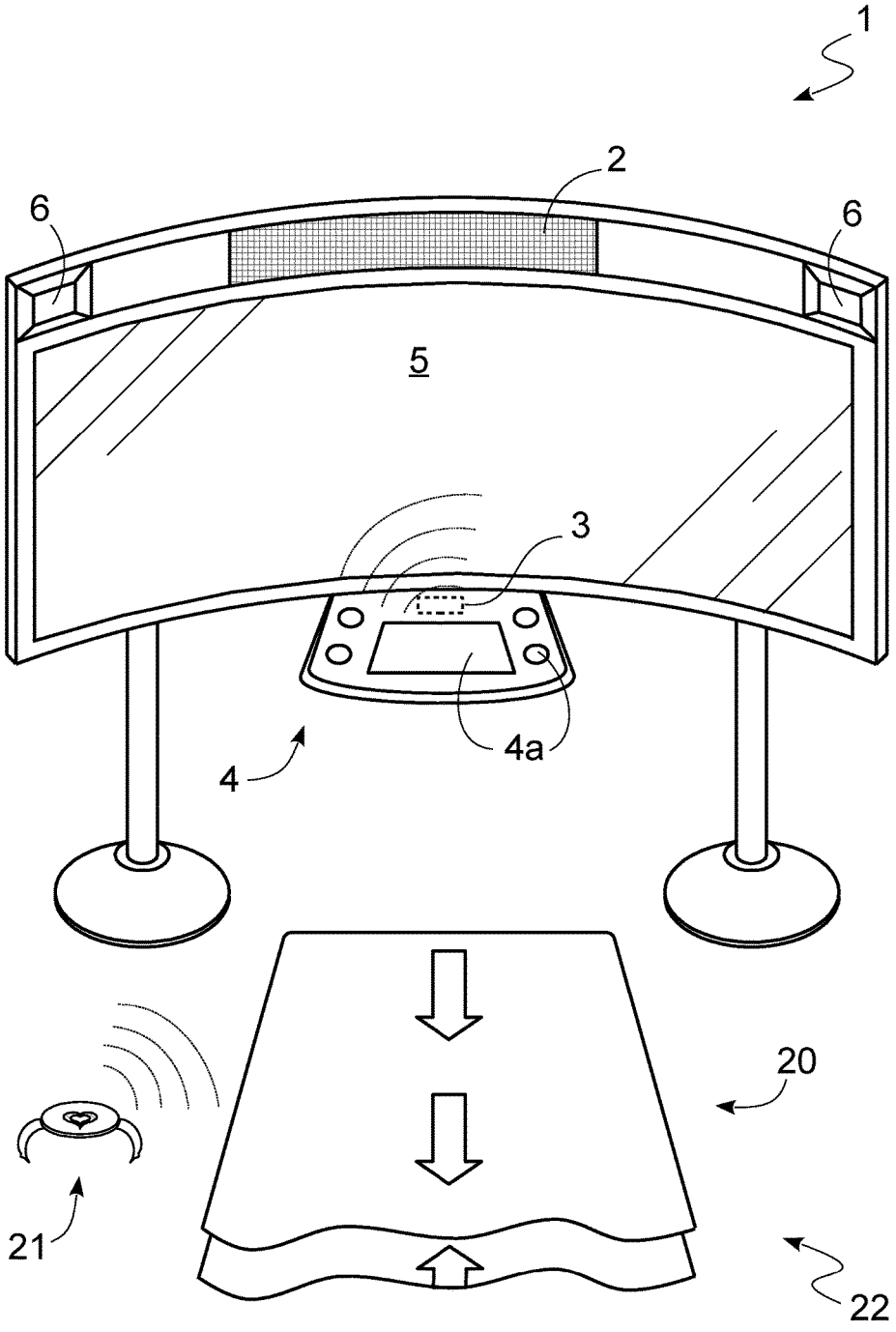
1
2
6
6
5
3
4a
4
20
21
22

DEVICE FOR PRACTICING SPORT ACTIVITIES

The present invention relates to a device for practising sports activities of the type described in the preamble of the first claim.

Various devices are currently known of for the practice of sports activities, such as exercise bikes, treadmills and the like.

Said devices are also frequently equipped with a small screen, to display frequencies, speeds, gradients and so forth.

Said devices have the drawback of not interacting sufficiently with the user.

In fact, the user follows the directions provided by said device but often with fatigue and difficulty.

For example, the device may alert the user to slow down or speed up and the user must follow the directions often with sudden changes in speed and heart rate.

In this situation, the technical task of the present invention is to obtain a device for practising sports activities capable of substantially overcoming said drawbacks.

A special technical purpose in the sphere of the general technical task of the present invention is to obtain a device for practising sports activities, which can help the user to adjust to the speed or frequency that the device is going to set.

The technical purpose and specified aims are achieved by a device for practising sports activities as claimed in the appended claim 1.

Preferred embodiments are evident from the dependent claims.

The characteristics and advantages of the invention are clearly evident from the following detailed description of a preferred embodiment thereof, with reference to the accompanying drawings, in which:

FIG. 1 is a schematic view of the device for practising sports activities according to the invention.

With reference to the FIGURES mentioned, the device for practising sports activities according to the invention is globally denoted by reference numeral 1.

It is suitable to be combined with an exercise machine 20, in particular to an exercise machine for aerobic activities, such as a treadmill, an exercise bike, a rowing machine, stepper, or so forth.

Preferably the device for practising sports activities is incorporated in said exercise machine 20, but, alternatively, the device for practising sports activities may be provided separately from the exercise machine 20.

The exercise machine 20 and the device for practising sports activities thus realise an exercise apparatus 22.

Said device, for practising sports activities 1 comprises a plurality of diffusers suitable to emit stimuli, such as acoustic, optical or the like, to the user.

In particular, the diffusers comprise at least one speaker 2 suitable to emit music or the like. It consists of a loudspeaker and a plug, physical or wireless, for an external device, such as headphones or so forth.

The device for practising sports activities 1 comprises then connection means 3 with a device for detecting psychophysical parameters 21.

Said connection means 3 are preferably of the wireless type and appropriately consist of a known connection, in particular the connection known by the brand name ANT+, which is a wireless connection used for devices such as pedometers, heart rate monitors, and so forth.

The device for detecting psychophysical parameters 21 is preferably a heart rate monitor or even, alternatively, a pedometer, a sensor suitable to detect breathing or other parameters. Said device for detecting psychophysical parameters 21 preferably comprises connection means compatible with the connection means 3, and in particular at least an antenna of the transmitting type ANT+, or BLUETOOTH® (a short range wireless communication standard) or so forth.

Alternatively, and advantageously, the connection means may be of the BLUETOOTH® (a short range wireless communication standard) type. In fact, the applicant has discovered that the magnetic fields and the structures of the device 1, which can block many frequencies, do not instead block BLUETOOTH® (a short range wireless communication standard) frequencies, in particular when the receiving antenna is positioned under the screen described below.

The diffusers may also comprise a screen 5 of the panoramic type or so forth.

In addition to the screen 5 the diffusers may comprise other lighting means 5*a*, such as LEDs producing a diffused light, preferably of different, selectable colours or so forth. For example said lighting means 5*a* may be selectable and controllable multicoloured LEDs placed behind the screen.

The device for practising sports activities 1 further comprises control means 4 of the device 1 itself, such as a small electronic device, for example an electronic processor or so forth. Said control means also comprise control means 4*a*, such as push-buttons or dials, touch screens i.e. sensitive to touch, or so forth.

The control means 4 include a programme of the activities to be performed and the relative intensity of said activities. In particular there are several programmes selectable by the user that provide for variations of intensity, for example changes in speed and/or gradient in a treadmill, or changes in speed and/or resistance of the pedals on an exercise bike or so forth.

The control means 4 are also functionally connected to the device for detecting psychophysical parameters 21 such as the heart rate monitor or the like.

Moreover, advantageously, the control means 4 are suitable to adjust the intensity of said stimuli, such as the said music or the like propagated by the loudspeaker 2 as a function of the values measured by the device for detecting psychophysical parameters 21 and the activities to be performed and the relative intensity, as further specified below in the description of the procedure.

In addition, said control means 4 are preferably also suitable to adjust the screen 5 as a function of the values measured by the heart rate monitor 21 and the activities to be performed and the relative intensity.

The diffuser may, lastly, comprise fragrance diffusers 6 also controllable by the control means 4 or the like and correlated to the values measured by the device for detecting psychophysical parameters 21.

Preferably, the fragrance diffusers are suitable to diffuse in an automatic manner and controlled by the control means 4, eight different fragrances suitable to stimulate the increase or decrease in the intensity of the physical activity.

The invention further comprises a new procedure, which further defines the operation of the device for practising sports activities 1, described above in structural terms.

As previously described, the device 1 is preferably combined or incorporated in an exercise machine 20, of the type described, defining the exercise apparatus 22. The new operating procedure for the device for practising sports activities 1 comprises a step of adjusting said stimuli, such as said music or the like, propagated by the diffusers, for example by the loudspeaker 2, of the light, fragrances or otherwise as a function of the activities to be performed and the relative intensity and preferably also of the values measured by the heart rate monitor 21.

In particular, the intensity of said stimuli is varied in direct proportion to the change in intensity of the activity.

For example, the intensity of said stimulus of the acoustic type is increased by increasing the frequency of the main beat, the intensity of the olfactory stimuli is adjustable by intensifying the same or by providing a more pungent fragrance, for example of citrus fruits, or otherwise as better specified below. Conversely, the intensity of said stimuli is decreased by performing the reverse operation.

Moreover, preferably, said procedure comprises a reading step of the values of the device for detecting psychophysical parameters 21, in which the control means 4 read and analyse the values supplied by the device 21, and in particular the frequency of the heartbeat or other parameters.

In particular, the frequency of the main beat of the music is accelerated in correspondence with, or in close proximity, to the increase in intensity of physical exercise, such as the increase in running speed or otherwise.

In addition, the frequency of the main beat of the music is decelerated at, or close to, the decrease in intensity of physical exercise, such as the decrease in running speed or otherwise.

Alternatively musical tracks are selected with different frequencies and suitable for increasing or decreasing the intensity of work.

Preferably, the operating logic described does not only match the programmes provided, but, for example, also the heartbeat or the data provided by the device 21. In fact, the control means 4 may detect that the heartbeat of the user is already high, and thus only slightly increase the frequency of the music for a subsequent increased pace.

On the contrary, the control means 4 may assess that the user requires a high increase in heartbeat, despite a scheduled mild increase in intensity, and programme and propose a significant increase in the musical frequency. Substantially, the device 1 exploits the power of music and its beat stimulating the athlete to achieve a pace suitable for every type of training program. By modulating the colour in pulses synchronised with the beat of the music it is easier to achieve the synchrony which increases athletic efficiency.

The same correlation may be created with other stimuli, even non-acoustic, proposed by said diffusers, such as light stimuli, olfactory stimuli, and so on.

The lighting means 5*a*, in fact, can use chromo stimulation to emphasise the chosen environmental theme during the physical exercise: this increases the peripheral visual sensation and broadens the perception of the atmosphere to be recreated indoors.

The lighting means 5*a*, moreover, have an autonomous sunlight 6500° K and e 6400° K light effect to favour the benefits of light therapy even in indoor environments. It is now well recognised that the absence of light similar to sunlight is perceived by the body as a limiting condition for optimal cell functioning. By means of light therapy, the athletic session is supported by stimulation at the cellular level of all parts of the body exposed. Light therapy can be disabled when the system is placed near large windows or well-lit by natural sunlight, or enabled at 50% or 100% depending on personal taste.

The screen 5 can lastly propose film clips with variable speed or rate of change of frames. In particular the speed of said films is accelerated in correspondence with, or in close proximity with the increase in intensity of physical exercise, such as the increase in running speed or otherwise. Or the speed of the film is decelerated at, or close to, the decrease in intensity of physical exercise, such as the decrease in running speed or other.

The screen 5 may propose motivational film clips or slide shows to the user with music and verbal inducement. It is known that during physical exercise and the consequent alteration of breathing it is easier to reach levels of reprogramming of thought. The inducements are not subliminal in nature and do not involve any unconscious manipulation, but can more easily reach a holistic level of awareness that helps promote the changes desired by the user.

Moreover, when the heart rate monitor detects that the user has exceeded a preset speed limit preferably studied on the user, an "alert" or alarm signal goes off and the device 1 advises the user to choose between a slower jog and cooling down.

Moreover, the fragrance diffusers 6 are suitable to select, via the control means 4, appropriate fragrances, more intense for an increase in physical activity and fainter for a decrease. In particular, intense and pungent fragrances, such as those of citrus fruit and the like, are suitable to stimulate an increase in intensity of physical activity, on the contrary lavender or other more delicate fragrances are suitable to stimulate the decrease in the intensity of physical activity. In addition, the olfactory channel reaches the nervous system faster than the others, facilitating achievement of a state of optimal performance.

The invention achieves important advantages.

In fact, the applicant has surprisingly found that by speeding up or slowing down the beat of the background music, or other stimuli indicated, the heart rate increases or decreases in a certain sense adapting to the musical beat.

The same benefit has been seen with images, or by selecting an appropriate fragrance.

The user is thus not unprepared to changes of pace, but his body, listening to music, sensing the fragrances and watching film clips, already adapts to the pace to keep almost without the user having to consciously implement said change in physical intensity.

The user is thus able to achieve optimal physical performance.

Moreover the lighting means 5*a* can treat the user according to the dictates of light therapy, improving the state of the user particularly when subject to sleep problems or jet-lag.

Variations may be made to the invention without departing from the scope of the inventive concept expressed in the claims and their technical equivalents. In said sphere all the details may be replaced with equivalent elements and the materials, shapes and dimensions may be as desired.

The invention claimed is:

1. A device for practicing sport activities associated with an exercise machine, said device for practicing sport activities comprising:

a plurality of diffusers operable to emit stimuli including at least one loudspeaker operable to emit music control means of said device for practicing sports activities, comprising a program of the sport activities to be performed and a relative intensity of said sport activities, connection means with a device for detecting a psychophysical parameter, wherein said control means are operable to adjust said emitted stimuli propagated by said plurality of diffusers according to values measured by said device for detecting the psychophysical parameter, and wherein said plurality of diffusers further comprises a fragrance diffuser operable to diffuse at least two different fragrances correlated to the values measured by said device for detecting the psychophysical parameter and controlled by the control means.

2. The device for practicing sport activities according to claim 1, wherein said plurality of diffusers comprises a screen.

3. The device for practicing sport activities according to claim 1, wherein said plurality of diffusers comprises lighting means.

4. The device for practicing sport activities according claim 1, wherein said device for detecting the psychophysical parameter is a heart rate monitor.

5. A method of a device for practicing sport activities, said device for practicing sport activities being associated with an exercise machine, said device for practicing sport activities comprising:

control means of said device for practicing sport activities, including a program of the sport activities to be performed and a relative intensity of said sport activities, a plurality of diffusers including a fragrance diffuser operable to diffuse at least two different fragrances correlated to values measured by a device for detecting a psychophysical parameter, the plurality of diffusers further including at least one speaker operable to emit music, wherein the plurality of diffusers are controlled by the control means, wherein said method comprises a regulation of said at least one fragrance and said emitted music according to the sport activities to be performed and the relative intensity of the sport activities, wherein said device for practicing sport activities further comprises connection means with the device for detecting the psychophysical parameter, and wherein said method further comprises a step of reading the values measured by said device for detecting the psychophysical parameter, and adjusting said at least one fragrance and said emitted music depending on the values measured by said device for detecting the psychophysical parameter.

6. The method according to claim 5, wherein said adjusting said emitted music depending on the values measured by said device for detecting the psychophysical parameter provides for a variation of said emitted music in a manner directly proportional to a variation of said relative intensity of said sport activities.

7. The method according to claim 6, wherein said adjusting said emitted music depending on the values measured by said device for detecting the psychophysical parameter provides for a variation of a beat of said emitted music, in a manner directly proportional to the variation of said relative intensity of said sport activities.

* * * * *